US005646662A

United States Patent [19]

Kitahara

[11] Patent Number: 5,646,662

[45] Date of Patent: Jul. 8, 1997

[54] RECORDING HEAD OF AN INK-JET TYPE

[75] Inventor: Tsuyoshi Kitahara, Nagano, Japan

[73] Assignee: Seiko Epson Corporation, Tokyo, Japan

[21] Appl. No.: 892,981

[22] Filed: Jun. 3, 1992

[30] Foreign Application Priority Data

| | | | |
|---|---|---|---|
| Jun. 4, 1991 | [JP] | Japan | 3-132895 |
| May 28, 1992 | [JP] | Japan | 4-161972 |

[51] Int. Cl.[6] ..... B41J 2/045; B41J 2/14

[52] U.S. Cl. ..... 347/70; 347/47

[58] Field of Search ..... 346/140; 205/75; 347/70, 47

[56] References Cited

U.S. PATENT DOCUMENTS

| | | | |
|---|---|---|---|
| 3,683,212 | 8/1972 | Zoltan | 346/140 X |
| 4,184,925 | 1/1980 | Kenworthy | 347/47 X |
| 4,209,794 | 6/1980 | Kattner | 346/140 |
| 4,282,533 | 8/1981 | Brooks et al. | 347/68 X |
| 4,312,009 | 1/1982 | Lange | 346/140 |
| 4,368,476 | 1/1983 | Uehara | 346/140 |
| 4,374,707 | 2/1983 | Pollack | 205/75 |
| 4,383,264 | 5/1983 | Lewis | 347/68 |
| 4,528,070 | 7/1985 | Gamblin | 347/47 X |
| 4,675,083 | 6/1987 | Bearss et al. | 204/11 |
| 4,678,680 | 7/1987 | Abowitz | 205/75 X |
| 4,914,736 | 4/1990 | Matsuda | 346/140 |
| 4,954,225 | 9/1990 | Bakewell | 205/75 |
| 4,962,391 | 10/1990 | Kitahara | 346/140 |
| 4,972,204 | 11/1990 | Sexton | 346/140 X |

FOREIGN PATENT DOCUMENTS

| | | | |
|---|---|---|---|
| 0416540 | 3/1991 | European Pat. Off. . | |
| 0506128 | 9/1992 | European Pat. Off. . | |
| 57-107848 | 7/1982 | Japan . | |
| 242545 | 10/1987 | Japan | B41J 3/04 |

*Primary Examiner*—Joseph W. Hartary

*Attorney, Agent, or Firm*—Sughrue, Mion, Zinn, Macpeak & Seas

[57] ABSTRACT

A recording head having a nozzle plate which has a sufficient thickness not to be deformed by a pressure vibration, and which is provided with concave portions on the back side of the plate with remaining a thickness corresponding to the longitudinal length of a nozzle in which concave portions of the nozzle are disposed. The concave portions formed on the back of the nozzle plate are arranged independently for each nozzle to suppress the influence of the pressure applied to the other nozzles as much as possible by utilizing the buffer function of each of the concave portions.

15 Claims, 3 Drawing Sheets

RECORDING HEAD OF AN INK-JET TYPE

BACKGROUND OF THE INVENTION

1. Field of the Invention

The present invention relates generally to a recording head of an ink-jet type for emitting droplets of an ink contained in an ink chamber for forming dots on a recording sheet by the kinetic energy of an electromechanical conversion means such as a piezo-electric vibrator or the like. More specifically, the invention relates to a configuration of nozzles of the recording head.

2. Related Art

A conventional recording head of the ink-jet type for emitting ink droplets to form characters or figures on a recording sheet as a set of dots is generally provided with a pressure chamber and a thin nozzle plate disposed to surround the pressure chamber, on which plate nozzles in a required number are formed.

The apparatus employing the thin nozzle plate has an advantage that the nozzles can easily be formed and also that the axial length of a nozzle relative to an diameter of its orifice can be limited within a predetermined range so that the efficiency of the ink emission can be improved.

However, in case that the diameter of the orifices is made smaller to emit small ink droplets thereby to improve the printing quality, it is necessary to employ a thinner nozzle plate accordingly. In this case, the rigidity of the thin plate is an important concern. Particularly, in case of the apparatus employing a piezoelectric vibrator as an ink droplet emitting member, if the nozzle plate is made extremely thin, it is readily deformed thereby emitting ink droplets in incorrect directions, especially in case of applying a load of 1–5 $kg/cm^2$ with high frequency repeatedly to the nozzle plate.

An apparatus has been proposed to resolve the aforementioned problem, as disclosed in U.S. Pat No. 4,282,533, which is provided with a nozzle plate having a sufficient thickness and grooves formed on the back thereof. According to this apparatus, the required number of nozzles are arranged on the bottom of the grooves. However, this type of thin nozzle plate still suffers from problems of another aspect. That is, even when one of the selected piezoelectric vibrators is actuated, the pressure causes a stress concentration along the longitudinal direction of the grooves so that the nozzle plate will largely bend, or the applied pressure propagates along the groove thereby to cause an undesired crosstalk phenomenon.

SUMMARY OF THE INVENTION

The present invention was made in view of the foregoing problems or difficulties accompanying the conventional recording head employing a thin nozzle plate. That is, an object of the invention is to provide a recording head of an ink-jet type having a nozzle plate capable of accurately emitting ink droplets without deforming the nozzle plate when pressure is applied for emitting the ink droplets.

Another object of the invention is to provide a recording head employing a nozzle plate by which a longitudinal length of a nozzle can have an ideal dimension as required relative to a diameter of the nozzle orifice by controlling the depth of a concave portion formed on the back of the nozzle plate.

It is still another object of the invention to provide a recording head employing a nozzle plate capable of effectively suppressing the undesired crosstalk phenomenon without arranging each of the nozzles completely separately.

The above and other objects can be achieved by the provision of a recording head having a nozzle plate which, according to the present invention, has a sufficient thickness not to be deformed by a pressure vibration, and which is provided with concave portions on the back side of the plate with the remaining thickness corresponding to the longitudinal length of a nozzle, in which concave portions the nozzle is disposed. The concave portions formed on the back of the nozzle plate are arranged independently for each nozzle to suppress the influence of the pressure applied to the other nozzles as much as possible by utilizing the buffer function of each of the concave portions.

DESCRIPTION OF THE PREFERRED EMBODIMENTS

Figure 1:
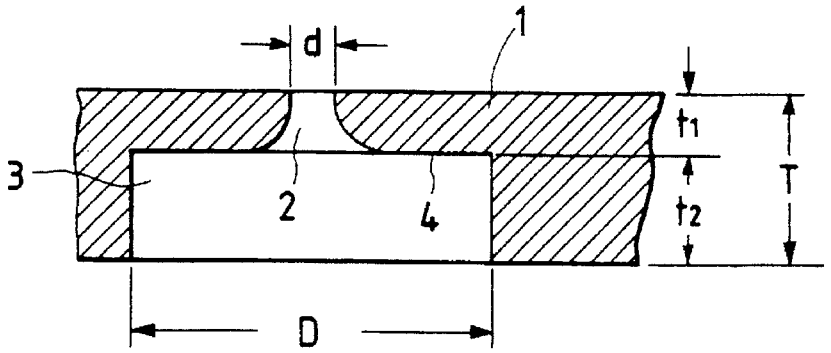
FIG. 1 is a cross-sectional view showing a nozzle plate according to the first embodiment of the invention.
Figure 2:
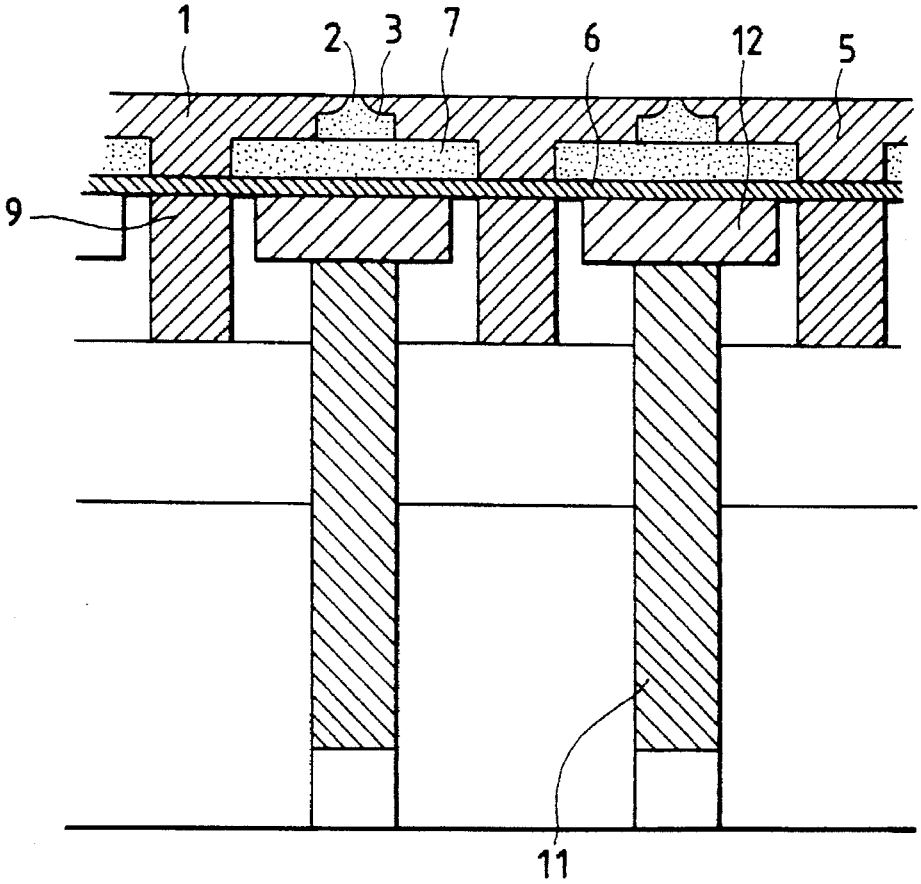
FIG. 2 is a cross-sectional view showing a recording head of an ink-jet type in which the nozzle plate of the first embodiment is arranged.
Figure 3:
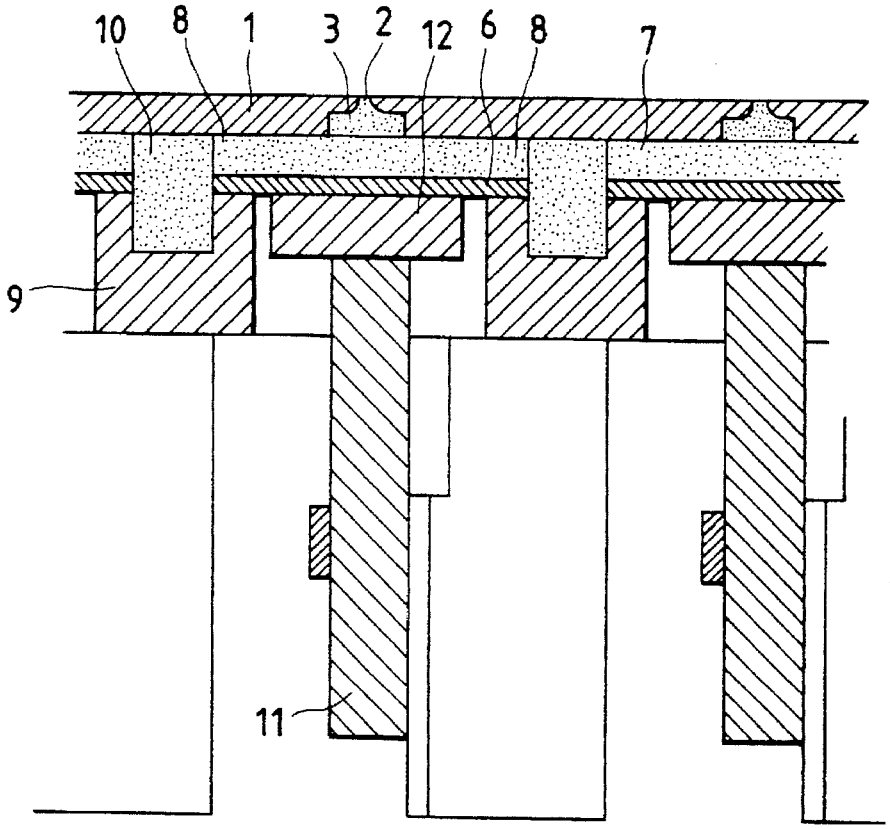
FIG. 3 is a front sectional view of the recording head shown in FIG. 2.
Figure 4:
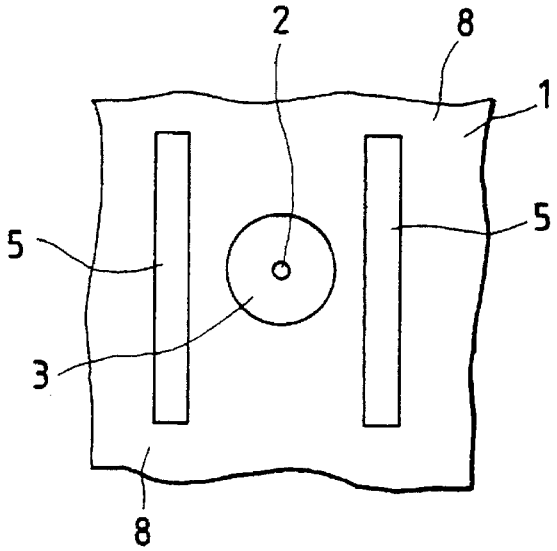
FIG. 4 is a plan view of the back of the nozzle plate according to the first embodiment of the invention.

FIGS. 1 through 4 are views showing a first embodiment of the invention. Specifically, FIG. 1 is a cross-sectional view showing a nozzle plate according to the first embodiment of the invention, FIG. 2 is a cross-sectional view showing a recording head of an ink-jet type in which the nozzle plate of the first embodiment is arranged, FIG. 3 is a front sectional view of the recording head shown in FIG. 2, and FIG. 4 is a plan view of the back of the nozzle plate according to the first embodiment of the invention.

A nozzle plate 1 is formed of a nickel plate having a thickness T which is sufficient for resisting pressure and vibration caused when ink droplets are emitted. The nozzle plate 1 is provided with a cylindrical concave portion 3 having a large inner diameter D. The thickness T of the nozzle plate 1 is expressed by the following equation:

$$T=t_1+t_2$$

where $t_1$ represents an ideal longitudinal length relative to a diameter d of the nozzle orifice, and $t_2$ represents a depth of the concave portion 3. For example, these dimensions can be set to $t_1$=30 μm, $t_2$=50 μm and T=80 μm.

The concave portion 3 of the nozzle plate 1 made by electroforming process and press-forming process is formed with a funnel-like nozzle 2 having the orifice diameter d of 30 μm, for example, on an inner bottom portion 4 by electroforming. Low partition walls 5 are unitary formed with the nozzle plate 1 and project therefrom to arrange each of the nozzles 2 to be separate and define an ink pressure chamber 7 with a pressure plate 6 disposed on the top of the plate 1.

The partition walls 5 are provided for preventing pressure applied to each of the ink pressure chambers 7 from influencing the adjacent ink pressure chamber. Since the nozzles 2 are formed in the deep end of the nozzle plate 1 through the respective concave portions 3, the partition walls 5 are not required to have a precise dimension because they are only required to partition each nozzles 2 from the others as shown in FIG. 4. Spaces formed at both sides of the partition wall 5 are utilized as an ink flow passage 8.

The recording head further includes a support plate 9 which urges and supports the other plane of the pressure plate 6, an ink supply passage 10 communicating with an ink tank (not shown in the figures), a piezoelectric vibrator 11 and a pressure receiving plate.

The recording head of the ink-jet type constructed as described above can employ the nozzle plate having a thickness sufficiently large, and the longitudinal length of the nozzle can have an ideal dimension by forming the concave portion on the back of the plate. Accordingly, ink droplets are emitted against a recording sheet stably and accurately in the proper emitting direction. Further, since the concave portions facing the nozzles are formed inside the nozzle plate 1 independently owing to the sufficient thickness thereof, the inner side space of the plate can be utilized as an ink buffer thereby to suppress the undesired influence of the pressure applied to one ink chamber to the others. Therefore, the crosstalk phenomenon can effectively be prevented.

In the above embodiment, the nozzle plate 1 is formed from a nickel plate. However, the nozzle plate 1 may be formed by laminating many foils each having a hole corresponding to the concave portion 3 and many foils each having a hole corresponding to the nozzle 2.

Figure 5:
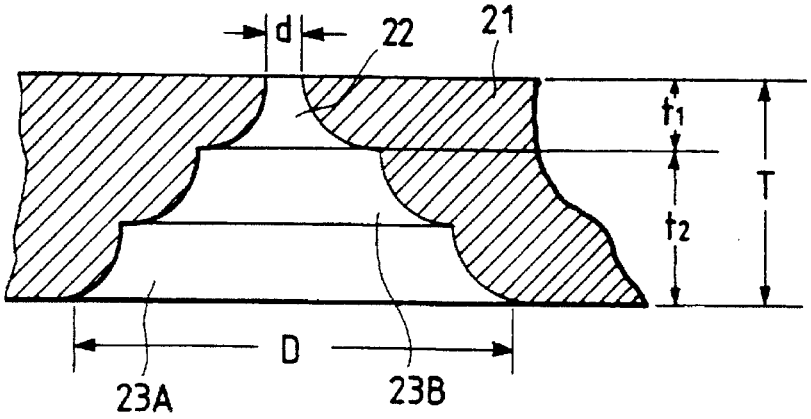
FIG. 5 is a cross-sectional view showing a nozzle plate according to a second embodiment of the invention.

FIG. 5 is a cross-sectional view showing a nozzle plate according to a second embodiment of the invention.

In the second embodiment shown in FIG. 5, a nozzle plate 21 is provided at the back thereof with a large concave portion 23A and a middle concave portion 23B coaxially with a nozzle 22. The large and middle concave portions 23A and 23B are formed by first and second electroforming processes. An inner surface of each of the concave portions has an arcuate shape in cross section which effectively prevents air bubbles contained in ink from being trapped by the surface of the concave portion and, accordingly, ink is allowed to flow smoothly.

The concave portion may consist of a single concave portion. However, the provision of two concave portions according to the second embodiment as shown in FIG. 5 is advantageous in that the remaining thickness of the nozzle plate can be controlled more precisely to be an ideal dimension corresponding to the longitudinal length of the nozzle 22 during the electroforming process for the second concave portion 23B.

According to the second embodiment described above, if the back surface of the nozzle 22 is subjected to fluorine resin eutectogenic plating with volatile ink, a peripheral surface at the opening of the nozzle 22 can be prevented from being wet.

Figure 6:
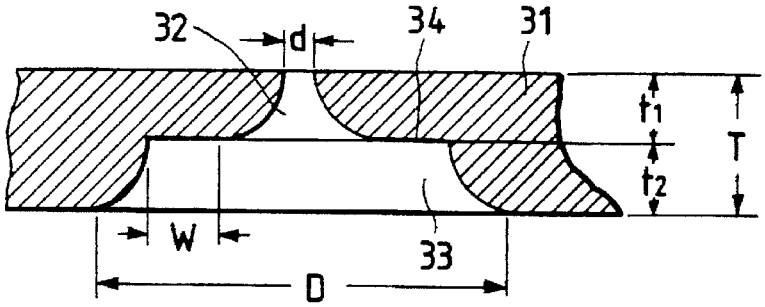
FIG. 6 is a cross sectional view showing a nozzle plate according to a third embodiment of the invention.

FIG. 6 is a cross sectional view showing a nozzle plate according to a third embodiment of the invention.

As shown in FIG. 6, a nozzle plate 31 is provided at the back thereof a single large concave portion 33 having a large diameter D coaxially with a nozzle 32. The concave portion 33 is formed by an electroforming process. According to the third embodiment, similar to the first embodiment shown in FIG. 1, an inner bottom 34 of the concave portion 33 has a ring-shaped flat surface having a large width W. The third embodiment utilizing the concave portion 33 having the flat surface at the bottom 34 thereof has advantages that a momentary pressure applied to the ink is balanced so that ink droplets can stably be emitted.

Figure 7:
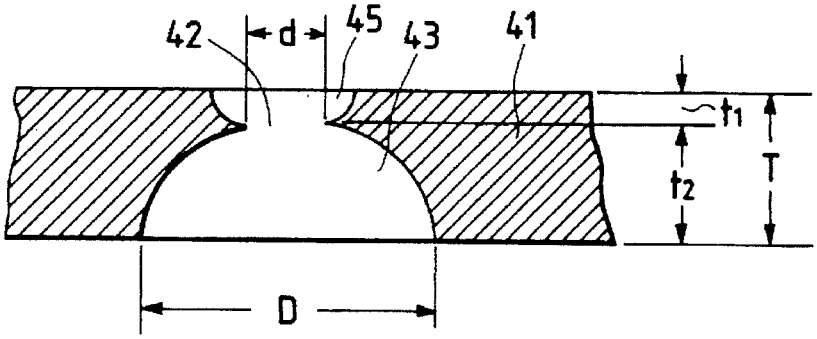
FIG. 7 is a cross sectional view showing a nozzle plate according to a fourth embodiment of the invention.

FIG. 7 is a cross sectional view showing a nozzle plate according to a fourth embodiment of the invention.

According to the fourth embodiment, a nozzle plate 41 formed of stainless steel is provided with a first semi-spherical concave portion 43 having a large diameter D and a depth $t_2$. The first semi-spherical concave portion 43 is formed by etching the stainless steel plate from the back surface thereof. The nozzle plate 41 is further provided with a second semi-spherical concave portion 45 having a small diameter by etching the plate 41 from a front side thereof towards the center of the first concave portion 43. A through hole communicating with the first and second semi-spherical concave portion 43 and 45 constitutes a nozzle 42 having a diameter d.

The nozzle 42 according to the fourth embodiment of the invention may have a disadvantage that the emitting direction of ink droplets is not constant because the concave portion is not funnel-like shaped, however, the nozzle 42 does not suffer from the problem of unstable emission of the ink droplets due to wetting because the opening end of the nozzle 42 is rapidly spreaded.

Figure 8:
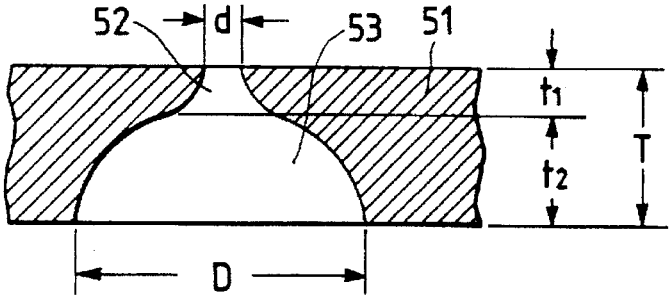
FIG. 8 is a cross sectional view showing a nozzle plate according to a fifth embodiment of the invention.

FIG. 8 is a cross sectional view showing a nozzle plate according to a fifth embodiment of the invention. The fifth embodiment is an arrangement of the nozzle plate of the fourth embodiment shown in FIG. 7.

In the fifth embodiment, a nozzle plate 51 is provided with a semi-spherical concave portion 53 having a depth $t_2$ formed by etching the plate from the back surface thereof and a funnel-like shaped nozzle 52 having a longitudinal length $t_1$ formed by etching the inner deep portion of the concave portion. According to the fifth embodiment, pressurized ink is allowed to smoothly flow from the concave portion 53 having a smooth semi-spherical shape to the funnel-like nozzle 52. Therefore, the ink droplets can be emitted more stably.

As described above, according to the invention, the recording head can accurately emit the ink droplets without deforming the nozzle plate even when pressure is applied for emitting the ink droplets.

Further, the recording head according to the invention employs a nozzle plate by which the longitudinal length of the nozzle can have an ideal dimension as required relative to the diameter of the nozzle orifice by controlling the depth of the concave portion formed on the back of the nozzle plate.

Furthermore, the recording head of the invention employs a nozzle plate capable of effectively suppressing the undesired crosstalk phenomenon without arranging each of nozzles completely separately.

What is claimed is:

1. An ink jet type recording head for emitting ink droplets against a recording sheet, comprising: a nozzle plate having a plurality of pressure chambers defined in a rear surface thereof, said pressure chambers being in fluid communication with one another, a nozzle orifice being formed through said nozzle plate for each of said pressure chambers, and a concave portion being formed at a rear end of each of said nozzle orifices communicating said nozzle orifices with a respective one of said pressure chambers, said concave portions having a diameter at least several times larger than a diameter of said nozzle orifices and being sufficiently large to suppress crosstalk between adjacent ones of said pressure chambers; a pressure plate covering one side of said pressure chambers; and a plurality of pressure transducers, one of said pressure transducers being provided for each of said pressure chambers for applying pressure to ink contained in a respective one of said pressure chambers through said pressure plate for expelling ink droplets through a respective one of said nozzle orifices.

2. The recording head according to claim 1, further comprising partition means for defining said ink pressure chambers independently for each of said nozzle orifices with said pressure plate, said partition wall forming an ink flow passage communicating with each of said ink pressure chambers.

3. The recording head according to claim 1, wherein said concave portions are cylindrical.

4. The recording head according to claim 1, wherein said concave portions are tapered spreading towards the back surface of said nozzle plate.

5. The recording head according to claim 1, wherein said concave portions spread stepwise.

6. The recording head according to claim 1, wherein said concave are semi-spherical.

7. The recording head according to claims 1, or 2, wherein said concave portions are semi-spherical, and further wherein a second semi-spherical concave portion is formed in a front surface of said nozzle plate around each of said nozzle orifices and extending towards said concave portions, whereby a hole communicating with both said concave portion forms said nozzle orifice.

8. The recording head of claim 1, wherein said nozzle plate is formed of a stainless steel by etching.

9. The recording head of claim 1, wherein a thickness T of said nozzle plate is expressed by an equation $T=t_1+t_2$ where $t_1$ represents an ideal longitudinal length of said nozzle while $t_2$ represents a depth of said concave portion.

10. The recording head of claim 9, wherein said ideal longitudinal length $t_1$ of said nozzle is 30 μm, said depth $t_2$ of said concave portion is 50 μm, and said thickness T of said nozzle plate is 80 μm.

11. The recording head of claim 1, wherein said concave portions are formed by an electroforming process.

12. The recording head of claim 7, wherein said second concave portions are formed by an electroforming process.

13. The recording head of claim 1, wherein said nozzle orifices are funnel-like shaped.

14. The recording head of claim 1, wherein each said concave portion consists essentially of a first and second concave portions formed by electroforming process.

15. The recording head of claim 1, wherein each said nozzle orifice is subjected to fluorine resin eutectogenic plating with volatile ink.

* * * * *